US006215246B1

(12) United States Patent
Kim et al.

(10) Patent No.: US 6,215,246 B1
(45) Date of Patent: Apr. 10, 2001

(54) SUBSTRATE STRUCTURE OF PLASMA DISPLAY PANEL AND ITS FABRICATING METHOD

(75) Inventors: Gun-Woo Kim; Jin-Young Kim, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/016,927

(22) Filed: Feb. 2, 1998

(30) Foreign Application Priority Data

Feb. 3, 1997 (KR) ..... 97-3244
Feb. 3, 1997 (KR) ..... 97-3246
Feb. 12, 1997 (KR) ..... 97-4163

(51) Int. Cl.[7] ..... H01J 17/49
(52) U.S. Cl. ..... 313/584; 313/586; 313/587
(58) Field of Search ..... 313/584, 586, 313/587; 345/60, 75

(56) References Cited

U.S. PATENT DOCUMENTS 4,638,218 * 1/1987 Shinoda et al. ..... 313/587 X
5,736,815 * 4/1998 Ameniya ..... 313/587 X

* cited by examiner

*Primary Examiner*—Ashok Patel
(74) *Attorney, Agent, or Firm*—Finnegan, Henderson, Farabow, Garrett, & Dunner, L.L.P.

(57) ABSTRACT

An electrode structure of a PDP (plasma display panel) and its manufacturing method, where the production cost is curtailed with the extension of life by forming a protection layer of excellent properties and low cost on an insulating substrate during the manufacture of the panel. The structure comprises two substrates coupled in parallel with each other by frit glass. One of the two substrates has sustain electrodes. One or more dielectric layers are formed over the sustain electrodes, and an interfacial reaction preventive layer and a protection layer are formed over the dielectric layers. The other substrate has address electrodes arranged thereon. A lower dielectric layer is formed over the address electrodes. Barriers coated with phosphor are formed between the upper and lower substrates. The protection layer may be deposited in a multilayered form by a spin coating method.

10 Claims, 2 Drawing Sheets

SUBSTRATE STRUCTURE OF PLASMA DISPLAY PANEL AND ITS FABRICATING METHOD

BACKGROUND OF THE INVENTION

A. Field of the Invention

The present invention relates to a PDP (Plasma Display Panel) and, more particularly, to a PDP substrate structure and its fabricating method.

B. Description of the Prior Art

A general color PDP, as shown in FIG. 1, has upper and lower structures. The upper structure comprises an upper substrate 1, a sustain electrode 3 formed on the upper substrate, a dielectric layer 4 for maintaining the surface charge generated during a discharge of the sustain electrode 3, and a protection layer 5. The lower structure comprises a lower substrate 2, and an address electrode 6 formed on the lower substrate 2. Barriers 7 coated with phosphor 8 are formed between the upper and lower substrates 1 and 2. A frit glass 9 is formed at the glass end portion, combining the upper and lower substrates 1 and 2.

Reference numeral 10 indicates a discharging gas sealed in a space between the upper and lower structures.

It is considered that the PDPs are the most suitable flat display device because they can display images at high speed and allow the manufacture of large-sized panels. In the past, AC and DC type PDPs having two electrodes have been used, and out of the two types of PDP, a surface discharge type AC PDP is considered to be the more suitable device for a color display.

To manufacture a conventional PDP, a pattern is first formed on the upper substrate 1 that has transparent electrodes. The side end portions of the transparent electrodes are coated with a metal that exhibits lower resistance than the transparent electrodes, so that the line resistance between the end portions of the electrodes can be reduced and thereby the quality deterioration of the sustain electrode 3 due to a driving voltage drop can be prevented. In another method of manufacturing the PDP, opaque metal electrodes are used instead of the transparent electrodes, and the dielectric layer 4 is formed on the whole surface of the electrodes to restrict the discharging current. The protection layer 5 is deposited on the whole surface, generally by an E-beam deposition using magnesium oxide, in order to protect the dielectric layer 4 against a sputtering that occurs during a discharge of the dielectric layer 4.

An electrode is formed vertically with respect to the two electrodes on the lower substrate 2, and barriers 7 are deposited between the electrodes so as to prevent a misdischarge in the adjacent discharge regions. Between the upper and lower substrates 1 and 2, combined with the frit glass 9, is filled with the discharging gas 10 and sealed completely.

When a voltage is applied to the sustain electrode 3 and the address electrode 6 of the finished PDP, a discharge takes place in the discharge region 10 on the surface of the dielectric and protection layers 4 and 5, generating ultraviolet rays.

While the electrons that exist in a discharge cell are accelerated toward the negative (–) electrode by the driving voltage applied, and collide with the mixture of inert gases filled in the discharge cell, the inert gases are excited to emit the ultraviolet rays.

The ultraviolet rays then collide with the phosphor 8 formed as thick as a predetermined thickness around the address electrode 6 and the barriers 7, generating visible rays to display a color image.

However, the conventional plasma display panel presents some disadvantages in that the panel whose life is at most about 5,000 hours needs a structural improvement to secure long life more than 30,000 hours. Moreover, the protection layer is generally formed by E-beam deposition and such formation by E-beam deposition results in low productivity because of the need for complicated process such as vacuum and heat treatments and the expensive equipment required therefor, thus raising the unit cost of products.

SUMMARY OF THE INVENTION

Accordingly, the present invention is directed to a substrate structure of a plasma display panel and its fabricating method that substantially obviates one or more of the problems due to limitations and disadvantages of the related art.

An object of the present invention is to provide a plasma display panel, with long life and high luminance, by forming a protection layer that is inexpensive to make and excellent in voltage-resistance characteristic due to an improvement in its structure and manufacturing process thereof.

To achieve the objects and in accordance with the purpose of the invention, as embodied and broadly described herein, the invention comprises a first substrate; a second substrate opposite the first substrate and spaced a distance therefrom; a first electrode over the first substrate; a first dielectric layer over the first electrode; a protection layer over the first dielectric layer; a second electrode over the second substrate and facing the first electrode; a second dielectric layer over the second electrode; and a phosphor over the second dielectric layer and being isolated from the second electrode.

According to a further aspect, the invention comprises a first substrate; a second substrate opposite the first substrate and spaced a distance therefrom; a first electrode over the first substrate; a dielectric layer over the first electrode; a protection layer over the dielectric layer; an interfacial reaction preventive layer between the dielectric layer and the protection layer preventing interaction therebetween; and a second electrode over the second substrate and facing the protection layer.

According to another aspect, the invention comprises a first substrate; a second substrate opposite the first substrate and spaced a distance therefrom; a first electrode over the first substrate; a first dielectric layer over the first electrode; a second electrode over the second substrate and facing the first dielectric layer; a phosphor over the second electrode; and a second dielectric layer between the phosphor and second electrode isolating the phosphor and the second electrode from each other.

According to a still further aspect, the invention comprises a first substrate; a second substrate opposite the first substrate and spaced a distance therefrom; a first electrode over the first substrate; a first dielectric layer having a first dielectric constant over the first electrode; a second dielectric layer over the first dielectric layer, the second dielectric layer having a second dielectric constant different from the first dielectric constant; and a second electrode over the second substrate and facing the second dielectric layer.

According to a further aspect, the invention comprises a first substrate; a second substrate opposite the first substrate and spaced a distance therefrom; a first electrode over the first substrate; a preventive layer between the first substrate and the first electrode preventing a short-circuit between the first electrode and an adjacent electrode; a dielectric layer over the first electrode; and a second electrode over the second substrate and facing the dielectric layer.

According to yet another aspect, the invention comprises a first substrate; a second substrate opposite the first substrate and spaced a distance therefrom; a first electrode over the first substrate; a dielectric layer over the first electrode; a second electrode over the second substrate and facing the dielectric layer; and a preventive layer between the second electrode and the second substrate preventing a short-circuit between the second electrode and an adjacent electrode.

According to another aspect, the invention comprises a method of fabricating a plasma display device having a first substrate and a second substrate opposite the first substrate and spaced a distance therefrom, comprising: forming a first electrode over the first substrate; forming a dielectric layer over the first electrode; and spin coating a protection layer over the dielectric layer and facing the second substrate.

According to a further aspect, the invention comprises a method of fabricating a plasma display panel having a first substrate and a second substrate opposite the first substrate and facing the first substrate, comprising: forming a first electrode over the first substrate; forming a dielectric layer over the first electrode; preheating the dielectric layer; spin coating a silicon oxide layer over the preheated dielectric layer; preheating the silicon oxide layer; spin coating a magnesium oxide layer over the preheated silicon oxide layer; and firing the magnesium oxide layer.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the present preferred embodiments of the invention, examples of which are illustrated in the accompanying drawings.

Figure 1:
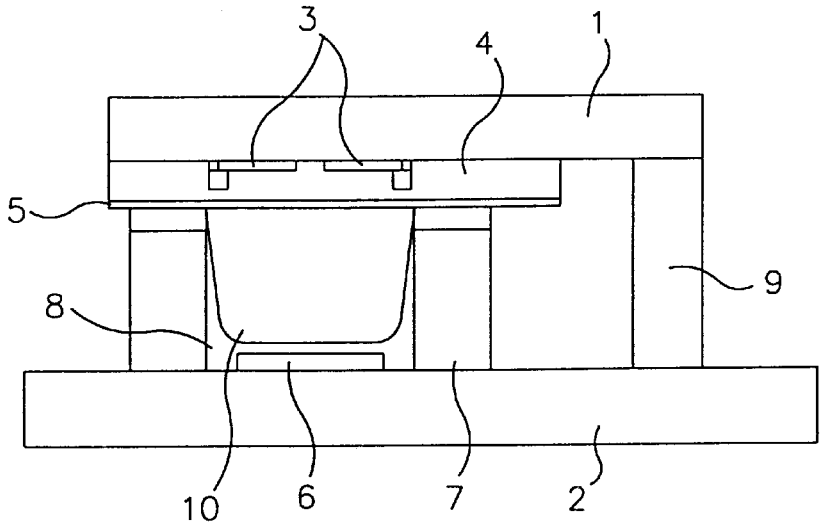
Fig. 1 (Prior Art)
FIG. 1 is a cross section of a conventional PDP.
Figure 2:
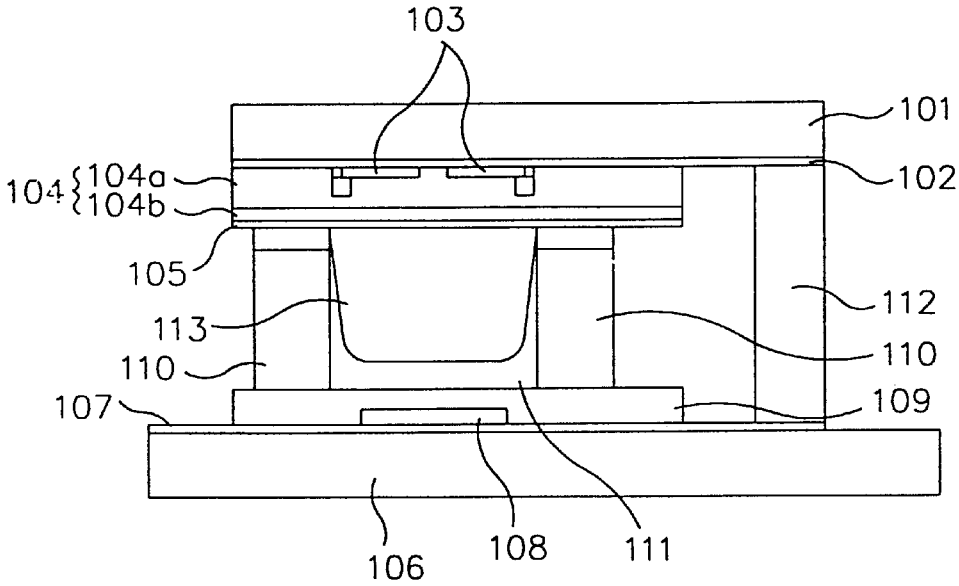
FIG. 2 is a cross section of a PDP in accordance with a first embodiment of the present invention.

FIG. 2 is a cross section of a PDP (plasma display panel) in accordance with a first embodiment of the present invention.

Referring to FIG. 2, the PDP comprises a first underlayer 102 formed on an upper substrate 101 out of two insulating substrates 101 and 102 arranged in parallel, upper electrodes 103 formed on the upper surface of the first underlayer 102, a double-layered upper dielectric layer 104 for restricting discharging current on the upper electrodes 103 so as to maintain the surface charge generated by a discharge of the upper electrodes 103, and a protection layer 105 formed on the whole surface of the upper dielectric layer 104 in order to protect the upper dielectric layer 104 against a sputtering that occurs during the discharge.

The lower structure comprises a second underlayer 107 formed right on the lower substrate 106, a lower electrode 108 formed on the upper surface of the second underlayer 107 and vertical with respect to the upper electrodes 103, a lower dielectric layer 109 formed on the whole surface of the lower electrode 108 to protect the lower electrode 108 by separating it from phosphor 111, that will be deposited later, barriers 110 for preventing a cross-talk between the adjacent discharge cells in the lower electrode 108, and phosphor 111 deposited on the opposite sides of the barriers 110 and on the lower dielectric layer 109.

Between the upper and lower substrates 101 and 106 is filled with an inert gas and sealed by a frit glass 112, forming a discharge region 113.

The first embodiment of the present invention as constructed above is formed in the following method.

Upper and lower structures are first formed by a separate process. To form the upper structure, silicon oxide is deposited on the upper surface of the upper substrate 101 to form the first transparent, underlayer 102 in the 20 to 90 nm range of thickness, in a simplified process, by either dipping or spin coating method.

The upper electrodes 103 are then formed on the first underlayer 102. Each upper electrode includes a transparent electrode and a metal electrode narrower than the transparent electrode, where the metal electrode is in contact with the transparent electrode. The metal electrode may be made of aluminum or black pigment-added aluminum. On the first underlayer 102 is formed the upper dielectric layer 104 which drops the driving voltage by generating wall charges. The upper dielectric layer 104 comprises a first dielectric layer 104*a* having high voltage-resistance, and a second dielectric layer 104*b* making the first dielectric layer 104*a* even and uniform in thickness. The first and second dielectric layers 104*a* and 104*b* contains silicon oxide and lead oxide, but the former has higher dielectric constant than the latter.

The first dielectric layer 104*a* is formed by carrying out a printing method two times, which is preferable to a deposition method in forming a dielectric layer of about 20 and 40 $\mu$m thick. The printing method is performed once or twice to form the second dielectric layer 104*b*.

Following the upper dielectric layer 104 formation, the frit glass 112 is formed at a sealing position by printing, dispensing method, or using a frit glass rod. The frit glass is tightly coupled to the upper substrate 101 by a heat treatment at about 400° C.

In order to prevent damages of the upper dielectric layer 104 against a discharge, the protection layer 105 is then formed by forming a uniform magnesium oxide layer of about 500 nm by an E-beam deposition.

To form the lower structure, electrodes are first formed on the lower substrate 106 by using an electrode paste. Especially, when they consist of silver (Ag), silver particles penetrate into the lower substrate 106 and cause a short circuit between the electrodes. To avoid the problem of short circuits, prior to the electrodes formation, the second underlayer 107 should be formed on the upper surface of the lower substrate 106 by either dipping or spin coating method as it is used to form the first underlayer 102 of the upper structure. The second underlayer 107 is preferably made of bright glass having a low melting point, which reflects visible rays generated in the discharge region 113 upward to enhance the entire luminance. The second underlayer 107 has a higher melting point than the barriers 110 and the lower electrode 108, and added with oxides in order to provide a bright reflecting layer.

The lower electrode 108 is formed on the second underlayer 107 by either printing, more usually performed, or metal deposition method. White color is brought out on the lower electrode 108 by a silver paste printing and a treatment under appropriate firing conditions in order to enhance the luminance.

Considering that damages of the electrode are less produced and the effective size is larger with the width of the lower electrode 108, the electrode should be manufactured in accordance with product design standards as large as not to cause a short circuit between adjacent electrodes.

On the whole surface of the lower electrode 108, the lower dielectric layer 109 is formed to prevent a direct contact between the lower electrode 108 and the phosphor 111, that will be formed later, protecting the lower electrode 108.

Following the lower dielectric layer 109 formation, the barriers are formed; the upper part is made of dark, low-melting-point glass to make a definite distinction between the discharge cells and enhance the product's contrast, and the other part is of bright, low-melting-point glass.

The phosphor 111 is formed on the side surfaces of the barriers 110 and on the surface of the lower substrate 106 usually by a printing method, uniformly printing a fluorescent paste that is prepared by a mixture of cellulose, acrylic resin thickener and organic solvent such as alcohol or ester. When the thickness of the phosphor 111 is not uniform, the display quality might be so deteriorated that the luminance and chrominance are not uniform and the discharge characteristics are unstable. To overcome the problem, the phosphor 111 is filled in a space between the barriers 110 and shaped by firing at about 400 to 600° C. The thickness of the phosphor 111, which depends on the amount of fluorescent paste, is about in the 10 to 50 $\mu$m range. If the phosphor 111 is too thick, the initial voltage for selective discharge increases and, when over 50 $\mu$m, a selective discharge will be difficult to take place in the driving region.

The lower substrate 106 is coupled to the upper substrate 101 by the frit glass 112. After the air is removed, between the upper and lower substrates 101 and 106 is filled with a mixture of inert gases such as Ne, He, Xe, or the like, and sealed completely.

Below is the description of the operation in accordance with the first preferred embodiment of the present invention as manufactured above.

When a voltage is applied to the upper and lower electrodes 103 and 108, a discharge occurs in the discharge region 113 on the surface of the upper dielectric layer 104 and the protection layer 105, generating ultraviolet rays. The ultraviolet rays collide with the phosphor 111 having a uniform thickness around the lower electrode 108 and the barriers 110, thereby the phosphor 111 emits light in the area of visible rays, thus the visible rays generated by light-emitted phosphor 111 display colors.

Figure 3:
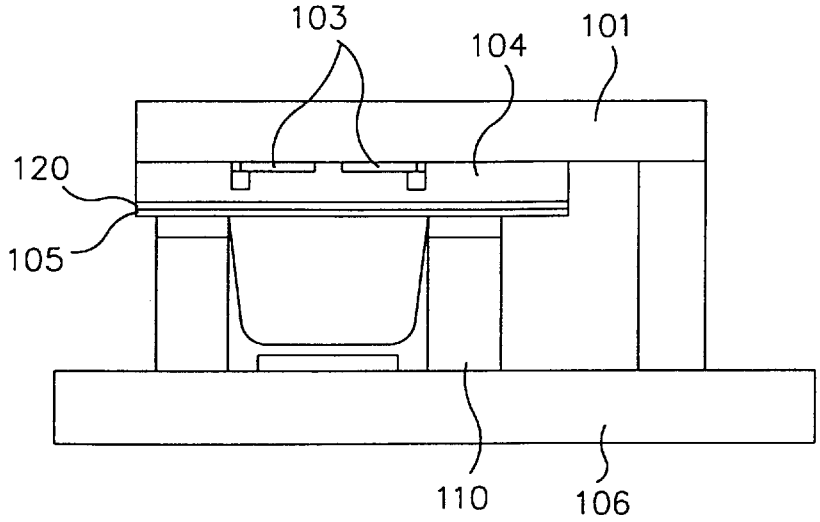
FIG. 3 is a cross section of a PDP in accordance with a second embodiment of the present invention.

FIG. 3 is a cross section of a second preferred embodiment of the present invention which is similar to the first preferred embodiment with the exception that, in order to prevent a direct contact between a dielectric layer 104 and a protection layer 105, an interfacial reaction preventive layer 120 is formed in the upper structure by a spin coating method to form a silicon oxide layer of about 1000 to 2000 Å thick. The direct contact between the dielectric layer and the protection layer causes undesirable sputtering and driving voltage characteristics because the contaminants introduced during the formation of the dielectric layer tend to react with the protection layer.

On the interfacial reaction preventive layer 120, the protection layer 105 is formed by using a spin coating method to form one to five magnesium oxide layers.

Figure 4:
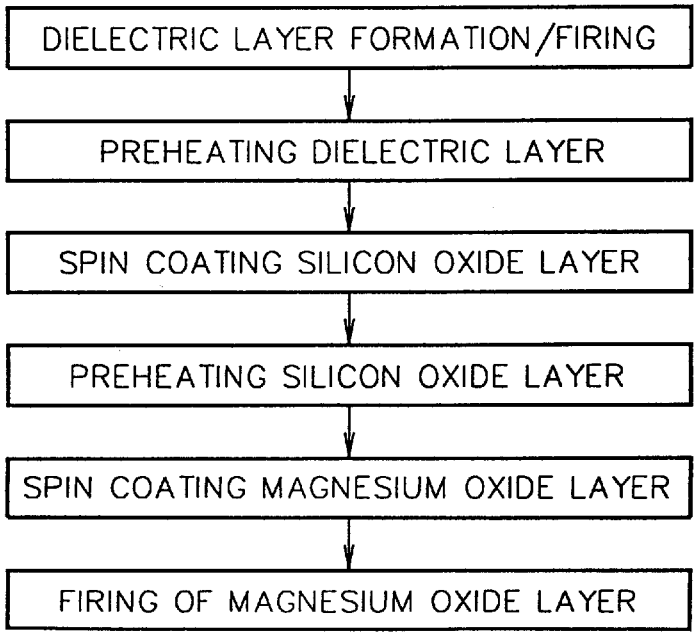
FIG. 4 is a flow diagram illustrating the process for forming a protection layer of the present invention.

A method of forming the protection layer in accordance with the second preferred embodiment will be described with reference to FIG. 4.

The surface of a dielectric layer formed by firing is preheated to a temperature in the 40 to 80° C. range. A silicon oxide layer is then formed on the preheated surface of the dielectric layer by a spin coating method. The above-mentioned interfacial reaction preventive layer is formed from a silicon oxide solution, solid silicon oxide of 1 to 5% by weight dissolved in alcohol or water. The layer thickness is between 1000 and 2000 Å. The interfacial reaction preventive layer is then preheated with an infrared lamp to a temperature in the 40 to 80° C. range. The protection layer is formed by spin coating the magnesium oxide solution one to five times and treated by firing between 400 and 500° C. for one hour. Finally, the above process completes in the protection layer that is inexpensive and excellent in characteristics on the upper substrate.

As described above, according to the first preferred embodiment of the present invention, the contrast and luminance of the panel can be enhanced and the panel has the life of at least 30,000 hours. In the second preferred embodiment of the present invention, multiple magnesium oxide layers are formed by an inexpensive spin coating in order to provide a protection layer that is excellent in sputtering-resistance, heat-resistance and voltage-resistance, thus realizing a low voltage drive and a unit costs reduction of driving IC.

In another embodiment, the PDP structure of the present invention includes a protection layer formed by a spin coating method at low cost, and an interfacial reaction preventive layer formed between the protection layer and a dielectric layer, the dielectric layer being formed in the multilayered form for the purpose of smoothness and uniformity in thickness of the layer.

It will be apparent to those skilled in the art that various modifications and variations can be made in the plasma display panel and its fabricating method of the present invention without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A plasma display panel, comprising:

a first substrate;

a second substrate opposite said first substrate and spaced a distance therefrom;

a first electrode over said first substrate;

a first dielectric layer over said first electrode, wherein said first dielectric layer includes a plurality of dielectric layers having at least two different dielectric constants;

a protection layer over said first dielectric layer;

a second electrode over said second substrate and facing said first electrode;

a second dielectric layer over said second electrode; and a phosphor over said second dielectric layer and being isolated from said second electrode.

2. A plasma display panel, comprising:

a first substrate;

a second substrate opposite said first substrate and spaced a distance therefrom;

a first electrode over said first substrate;

a first dielectric layer over said first electrode, wherein said first dielectric layer includes a first dielectric sublayer, and a second dielectric sublayer over said first dielectric sublayer, said second dielectric sublayer providing a substantially smooth surface for said first dielectric layer;

protection layer over said first dielectric layer;

a second electrode over said second substrate and facing said first electrode;

a second dielectric layer over said second electrode; and a phosphor over said second dielectric layer and being isolated from said second electrode.

3. A plasma display panel, comprising:

a first substrate;

a second substrate opposite said first substrate and spaced a distance therefrom;

a first electrode over said first substrate;

an underlayer between said first substrate and said first electrode to prevent a short-circuit between said first electrode and an adjacent electrode;

a first dielectric layer over said first electrode;

a protection layer over said first dielectric layer;

a second electrode over said second substrate and facing said first electrode;

a second dielectric layer over said second electrode; and a phosphor over said second dielectric layer and being isolated from said second electrode.

4. A plasma display panel, comprising:

a first substrate;

a second substrate opposite said first substrate and spaced a distance therefrom;

a first electrode over said first substrate;

a protection layer over said first dielectric layer;

a second electrode over said second substrate and facing said first electrode;

an underlayer between said second substrate and said second electrode to prevent a short-circuit between said second electrode and an adjacent electrode;

a second dielectric layer over said second electrode; and a phosphor over said second dielectric layer and being isolated from said second electrode.

5. The plasma display panel as defined in claim 3 or 4, wherein said underlayer includes silicon oxide.

6. The plasma display panel as defined in claim 3 or 4, wherein said underlayer has a thickness of 20 to 90 nm.

7. A plasma display panel, comprising:

a first substrate;

a second substrate opposite said first substrate and spaced a distance therefrom;

a first electrode over said first substrate;

a dielectric layer over said first electrode;

a protection layer over said dielectric layer;

an interfacial reaction preventive layer between said dielectric layer and said protection layer preventing interaction therebetween; and a second electrode over said second substrate and facing said protection layer.

8. The plasma display panel as defined in claim 7, wherein said interfacial reaction preventive layer includes a low-melting-point glass containing silicon oxide.

9. The plasma display panel as defined in claim 7, wherein said interfacial reaction preventive layer has a thickness of 1000 to 2000 Å.

10. The plasma display panel as defined in claim 7, wherein said interfacial reaction preventive layer includes silicon oxide.

* * * * *

UNITED STATES PATENT AND TRADEMARK OFFICE

CERTIFICATE OF CORRECTION

PATENT NO. : 6,215,246 B1 
DATED : April 10, 2001
INVENTOR(S) : Gun-Woo Kim et al.

It is certified that error appears in the above-identified patent and that said Letters Patent is hereby corrected as shown below:

Column 7,
Line 13, before "protection layer," insert -- a --.

Column 8,
Line 1, after "first substrate;", insert the following line:
-- a first dielectric layer over said first electrode; --.

Signed and Sealed this

Twenty-fifth Day of June, 2002

*Attest:*

*Attesting Officer*

JAMES E. ROGAN
*Director of the United States Patent and Trademark Office*